United States Patent [19]

Charpentier

[11] 3,957,254

[45] May 18, 1976

[54] DOOR OPENING MECHANISM FOR ROTATING DRUM

[75] Inventor: Jean G. Charpentier, Massy, France

[73] Assignee: Societe Anonyme dite: S.I.E.T.A.M., France

[22] Filed: Sept. 9, 1974

[21] Appl. No.: 504,146

[30] Foreign Application Priority Data

Sept. 25, 1973 France ..... 73.34376

[52] U.S. Cl. ..... 259/89; 34/108; 49/280; 204/213

[51] Int. Cl.[2] ..... B01F 9/00

[58] Field of Search ..... 259/89; 204/213, 214; 49/280; 292/149; 34/108; 62/381

[56] References Cited

UNITED STATES PATENTS

| | | | |
|---|---|---|---|
| 3,472,753 | 10/1969 | Wojtanek | 259/89 X |
| 3,583,739 | 6/1971 | Gill | 204/213 X |
| 3,668,103 | 6/1972 | Singleton | 204/213 |

*Primary Examiner*—William O'Dea
*Assistant Examiner*—Ronald C. Capossela
*Attorney, Agent, or Firm*—Bucknam and Archer

[57] ABSTRACT

This invention relates to an electrolytic treatment drum of the type suspended by a drive pulley.

This drum comprises a double-flanged wheel in which passes the suspension and drive belt, this drum comprising an inwardly opening door, of which the axis is fast with an arm provided with a catch, which, during rotation, is pushed by the belt into one of two notches according to the direction of rotation, opening or closing the door.

2 Claims, 2 Drawing Figures

FIG. 1
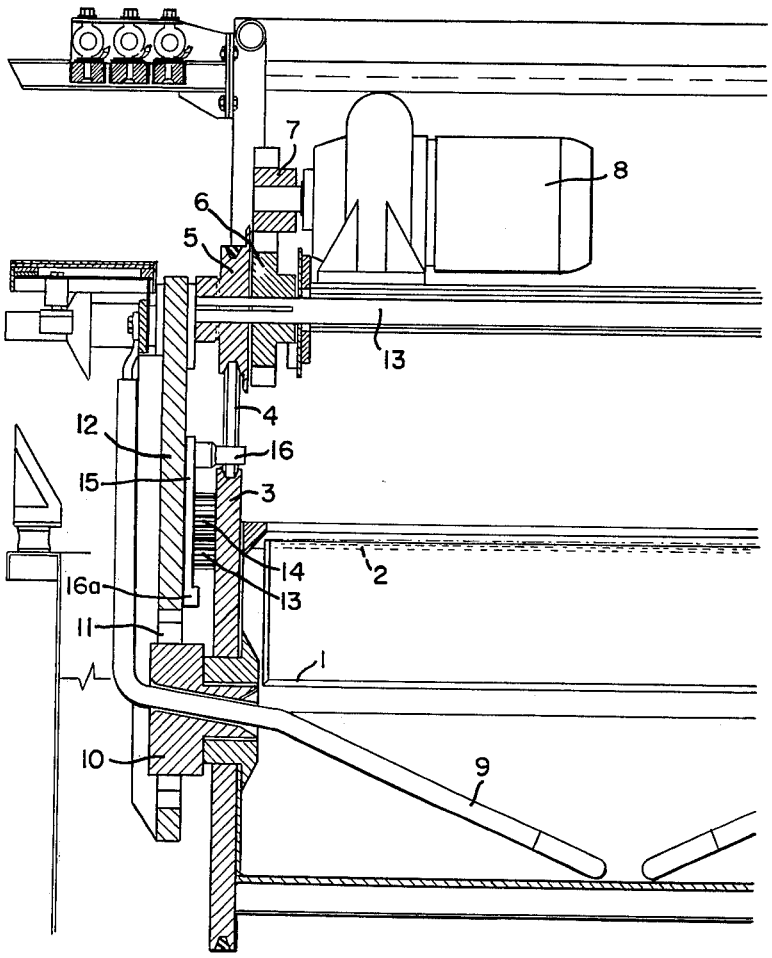
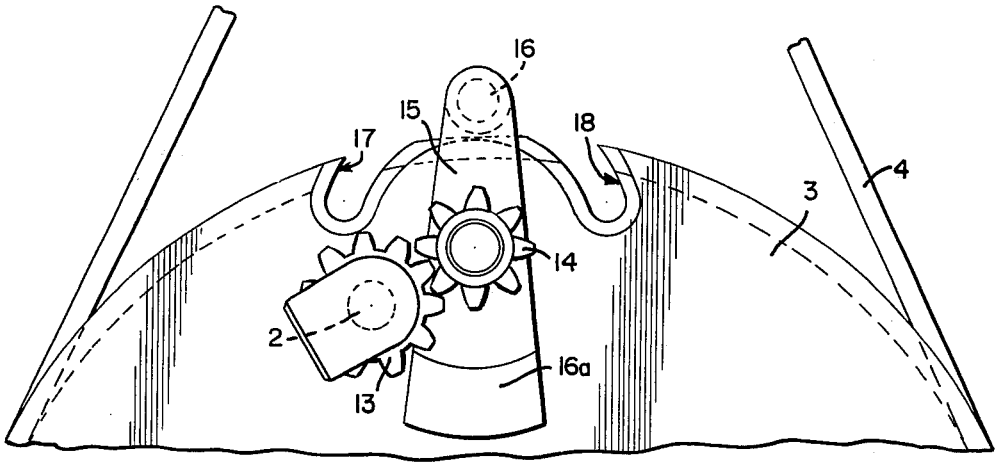
FIG. 2

DOOR OPENING MECHANISM FOR ROTATING DRUM

The present invention relates to an electrolytic treatment drum.

Drums are known which comprise a swing door opening or closing automatically depending on the direction of rotation. In these gear-driven drums, the door is securely fixed to a lever provided with a roller which rolls on a fixed cam comprising a housing in which the roller penetrates, the arm being in swinging, closing or opening position of the door according to the direction of rotation.

For drums suspended on drive belts passing in the grooves of the wheels fixed at the end of the drum, such a system cannot be used.

The invention therefore has for its object an electrolytic treatment drum of the suspended type in which each end of the drum comprises a double-flanged wheel in which a suspension belt passes to a rotary drive pulley, wherein it comprises a door opening inwardly in the drum, this swing door being connected by connecting means to a pivoting arm mounted on the drum and provided with a catch which is housed in one or the other of two notches made in the groove and of a depth substantially equal to the depth of the groove plus the diameter of the catch.

The invention will be more readily understood on reading the following description with reference to the accompanying drawings, in which:

FIG. 1 is a view in axial section of a drum according to the invention;

FIG. 2 is a view on a larger scale in the direction of arrow F of FIG. 1.

Referring now to the drawings, the surface treating drum is of the suspended type of polygonal form with a swing door 1 mounted on an axis 2.

The drum comprises laterally on each side a double-flanged wheel 3 in which a suspension belt 4 passes to a drive pulley 5, which is connected by a set of gears 6 and 7 to a motor 8, the drum comprises electrodes 9 which pass through a member 10 forming hub for the wheel 3, which hub is prevented from rotating, but may slide in an opening 11 of a guide support 12 on which the shaft 13 of the pulley 5 and the motor is mounted.

According to the invention, the axis 2 of the door which opens inwardly of the drum is provided at least one of its ends with a pinion 13 or toothed sector meshed with a pinion 14 or toothed sector, which is mounted on the wheel 3. The pinion 14 is securely fixed to an arm 15 which, in radial position, passes beyond the wheel 3 and comprises at its end a catch 16 which, by pivoting of the arm, is housed in one of the two notches 17 and 18 made in the groove of the wheel 3, a counter-weight **16*a* being provided opposite the catch 16 with respect to the pinion 14**.

Thus, when the drum rotates, the catch abuts against the belt 4 and, with the rotation continuing, the catch is pushed in notch 17. For the reverse direction of rotation, the catch is pushed in the notch 18. During one revolution, the catch is maintained in the notch by the belt. The pinions 13 and 14 are calculated and mounted so that the door is closed for the catch in one notch and open for the catch in the other notch.

What we claim is:

1. A drum of the suspended type which comprises a double flanged wheel laterally at each end of the drum, a belt for suspension of said wheel to a rotary drive pulley, a swing door opening inwardly in the drum, a pivoting arm mounted on the drum, means for connecting said swing door to said arm, said arm having a catch, said door having a groove, said groove having notches for engagement with said catch, said notches being of depth substantially equal to the sum of the depth of the groove and the diameter of the catch, whereby rotation of the drum in one direction causes the door to swing open and rotation in the opposite direction causes the door to close.

2. A drum as claimed in claim 1, wherein the arm carrying the catch is mounted on a pinion meshed with a pinion fast with the axis on which the swing door pivots.

* * * * *